US005120093A

United States Patent [19]

Carney

[11] Patent Number: 5,120,093

[45] Date of Patent: Jun. 9, 1992

[54] FLOOR-MOUNTED POSITIVE DOORSTOP

[76] Inventor: Donald Carney, 323 Riverside Dr., Seaford, Del. 19973

[21] Appl. No.: 610,745

[22] Filed: Nov. 8, 1990

[51] Int. Cl.[5] ..... E05C 5/02; E05F 5/06

[52] U.S. Cl. ..... 292/60; 292/DIG. 15; 16/82

[58] Field of Search ..... 16/82; 292/DIG. 15, 292/60

[56] References Cited

U.S. PATENT DOCUMENTS

| | | | |
|---|---|---|---|
| 760,528 | 5/1904 | Davies | 292/60 |
| 776,178 | 11/1904 | Guedeney et al. | 292/60 |
| 1,271,363 | 7/1918 | Ralston . | |
| 1,895,146 | 1/1933 | Brown . | |
| 2,929,647 | 3/1960 | Gladstone | 16/82 |
| 4,462,623 | 7/1984 | Grant . | |
| 4,797,970 | 1/1989 | Charlton . | |

FOREIGN PATENT DOCUMENTS

| | | | |
|---|---|---|---|
| 888220 | 8/1953 | Fed. Rep. of Germany . | |
| 942494 | 5/1956 | Fed. Rep. of Germany . | |
| 1584058 | 10/1966 | Fed. Rep. of Germany | 292/DIG. 15 |

*Primary Examiner*—Robert L. Spruill
*Assistant Examiner*—Carmine Cuda
*Attorney, Agent, or Firm*—Shoemaker and Mattare, Ltd.

[57] ABSTRACT

A floor-mounted doorstop comprises a tubular housing having an upper flange which is affixed to the floor, and a closed lower end. A plunger is telescopically received within the bore of the housing, compressing a coil spring which normally drives it to its deployed position; however, the plunger can be depressed with the foot, and a twist of the foot latches it in a retracted position.

4 Claims, 2 Drawing Sheets

FLOOR-MOUNTED POSITIVE DOORSTOP

BACKGROUND OF THE INVENTION

This invention relates generally to closures, and more particularly to a doorstop which is mounted in a floor below the path of a swinging door.

Prior inventors have provided a variety of doorstops from the common chocks to sophisticated mechanical devices intended for special applications.

A number of prior devices include floor-mounted units having a stop which can be raised to interfere with motion of a swinging door. Of interest are the stops shown in U.S. Pat. Nos. 4,462,623, 4,797,970, 1,895,146 and 1,271,363, and German Patents 888,220 and 942,494.

The U.S. Pat. No. 4,462,623 is the most pertinent prior patent of which we are presently aware. It discloses a door stopper including a stationary, outer cylindrical housing mounted in the floor by means of screws passing into the floor through holes in a circumferential flange at the upper end of the housing. A cylindrical inner housing is retained within the outer housing, and is biased upward by a coil compression spring placed between the lower, closed end of the outer housing and an abutment on the inner housing. When the inner housing is telescoped to its upper position, it blocks a door from passing the device. However, the stop may be retracted by applying foot pressure to the inner housing, forcing it into the outer housing, where it is retained in its lower position by a stop mechanism having outwardly spring-biased balls, that engage a ring mounted on the interior surface of the outer housing, to hold the inner housing in its retracted position. The stop can be deployed by depressing the stop, and then quickly releasing it, so that its momentum overcomes the detent action of the balls.

The present invention, while basically similar to that described in the preceding paragraph, is more simply constructed, and therefore less expensive to produce, and potentially more durable.

SUMMARY OF THE INVENTION

One of my objectives in making the present invention was to produce a floor-mounted door stop of the simplest possible construction. A related object was to make such a stop with as few parts as possible, to minimize the opportunity for failure. In realizing this objective, the preferred embodiment of my device has only four parts, excluding mounting hardware.

Another object of the invention is to provide a doorstop which is quickly and easily moved between deployed and retracted positions merely by a twist of the foot.

The invention is embodied in a floor-mounted door stop comprising an outer cylindrical housing containing an inner cylindrical stop which is upwardly biased with respect to the stop by a compression spring, and which is retained in its lower or upper position by a pin extending from the stop into an "L" shaped slot in the outer housing.

BRIEF DESCRIPTION OF THE DRAWINGS

In the accompanying drawings.

DESCRIPTION OF THE PREFERRED EMBODIMENT

Figure 2:
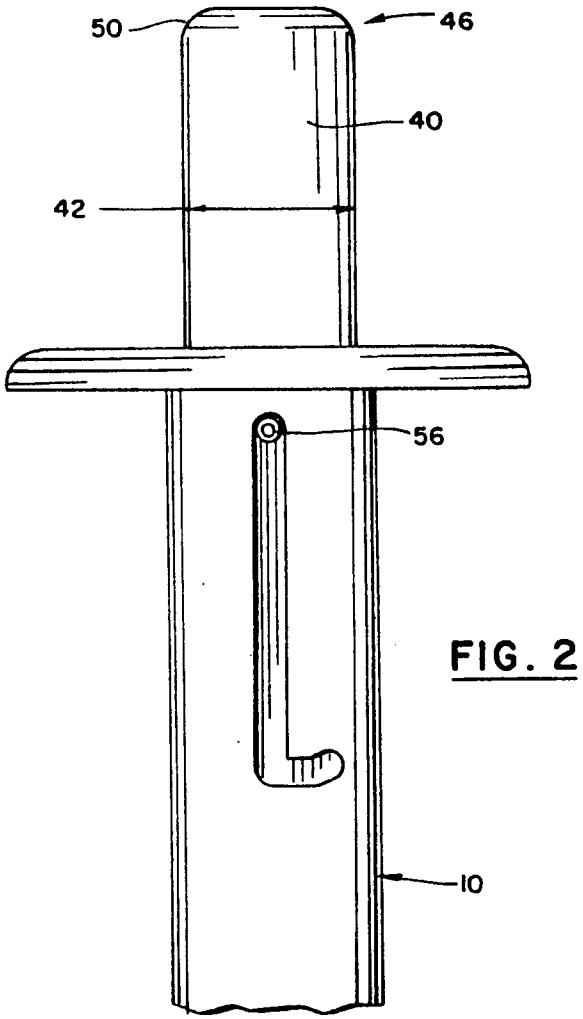
FIG. 2 is a corresponding view showing the stop deployed.
Figure 1:
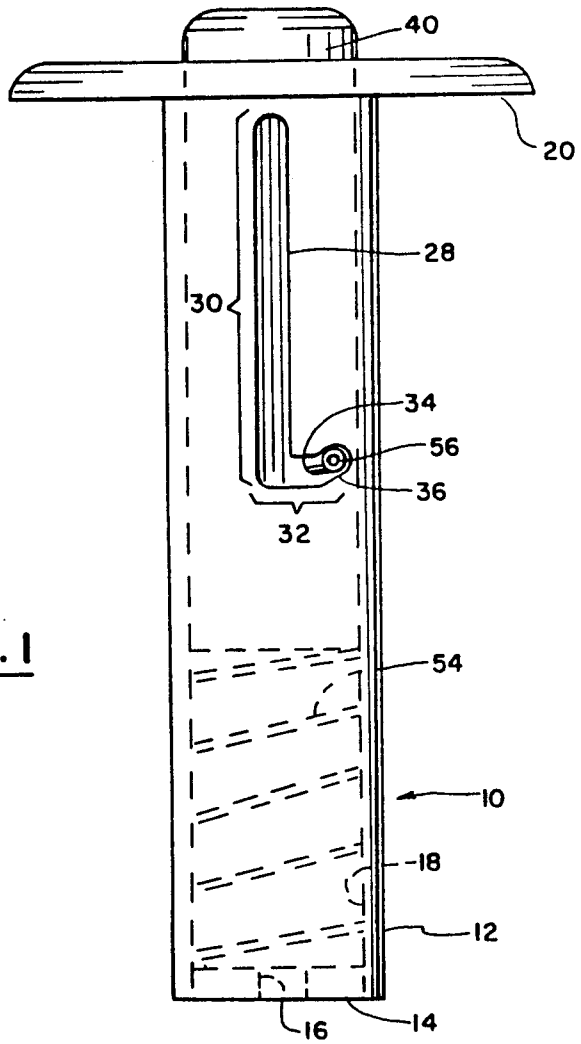
FIG. 1 is a side elevation of the invention, with the stop retracted.
Figure 3:
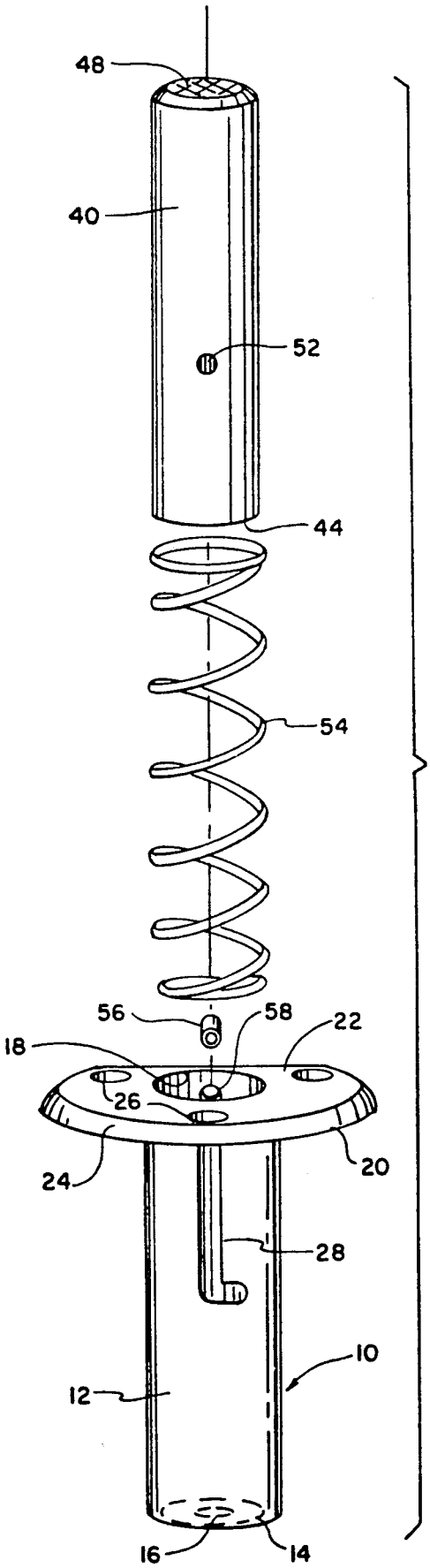
FIG. 3 is an exploded perspective view of the invention.

A floor-mounted door stop embodying the invention comprises an outer housing 10 containing a plunger 40 retained therein for limited telescoping movement along the axis of the device, which in most cases would be vertical, as shown in the drawings. The stop would work equally well in any orientation, but for clarity of description, a vertical orientation is assumed.

The housing 10 is an unitary item formed from a tube 12 whose lower end is closed by a plug 14 welded into the tube at the bottom. The plug has a central hole 16 which allows dirt and liquids to pass through the device, to keep them from accumulating therein. The bore 18 of the outer housing is of uniform diameter from the plug to the upper end; no detent rings or other structure are required within the bore. Therefore, the clearance between the plunger and the bore can be small, thus minimizing tipping of the stop member under load.

A flange 20, extending radially outward from the tube 10, is welded flush with the upper end of the tube 12. This flange, formed from stout plate material compatible with that of the tube, has a segment removed, leaving a flat side 22 which, like the remaining periphery 24 of the flange, has an esthetically rounded edge that deflects items moving over the floor surface. The flat side of the flange is intended to provide clearance when the stop is placed adjacent a raised structure such as the threshhold of the door. Three countersunk holes 26 in the flange receive mounting screws (not shown) that are threaded into the floor.

An L-shaped slot 28 is cut through one side of the tube. This slot comprises an upper leg 30 that extends downwardly from just below the flange to a point intermediate the ends of the tube. A lower leg 32 of the slot extends at a right angle from the lower end of the upper leg a short distance: the lower leg actually comprises two segments, namely a circumferential segment 34 extending perpendicularly from the upper leg, plus a dogleg 36 that extends slightly obliquely upward from the end of the circumferential segment, forming a detent.

The plunger 40 is generally cylindrical, having an outer diameter 42 sized for easy sliding movement within the bore of the housing. The bottom end 44 of the plunger is preferably flat, while the upper end 46 preferably has a flat surface embossed with a pattern of diamonds 48 (or otherwise roughened to provide good traction with the sole of a shoe), surrounded by a generously radiused edge 50. The stop member is preferably solid, although a hollow construction could alternatively be employed.

The plunger has a radial through hole 52 intermediate its ends.

A compression coil spring 54 is placed in the housing, and rests upon the upper surface of the bottom plug 14. The plunger, inserted into the housing above the spring, is degressed sufficiently, and rotated if necessary, to bring the hole 52 into alignment with the slot. At this point a roll pin 56 is inserted through the slot, into the hole 52, and is driven into the hole to a joint at which its leading end is still within the stop member, and its trailing end extends well into the slot. The pin now serves not only to retain the parts in their assembled condition, but also to limit movement of the plunger both upward, to its deployed position, and downward, to its retracted position. The housing preferably has a hole 58, slightly larger than the pin diameter, diametrically opposite a portion of the slot, so that the pin can be punched out, in case the device needs to be disassembled or disabled.

To latch the plunger in its retracted position, one need only depress it with the foot, and twist it counterclockwise, bringing the pin into the dogleg segment of the slot. The spring tension is chosen to be sufficient at this point to resist inadvertant unlatching: however, a deliberate depression and clockwise twist of the plunger easily releases it from the retracted position.

It can be seen that the plunger is particularly robust, and that there are no complicated mechanisms or delicate parts to be damaged by the abuse to which door stops are likely to be subjected, nor fouled by the dirt likely to enter the device.

The plunger and housing portions of the invention are preferably made from aluminum alloy; however, the material is not critical, and the choice of other suitable materials is within the skill of the artisan.

Inasmuch as the invention is subject to other modifications and variations, it is intended that the foregoing description and the accompanying drawings shall be interpreted as illustrative of only one form of the invention, whose scope is to be measured by the following claims.

I claim:

1. In a floor-mounted door stop comprising a stationary housing comprising a tube having a bore, a plunger telescopically retained within the bore, a spring acting between the housing and the plunger to bias the plunger upward toward a deployed position, said tube having a substantially "L"-shaped slot in its periphery, a pin extending from the plunger into said slot for holding the plunger in a downward, retracted position, the improvement wherein the plunger has a through-hole in which the pin is inserted, and the housing has a round hole in its side diametrically opposite the upper end of the slot, thereby enabling one to punch out the pin and to lock the plunger in it deployed position.

2. The invention of claim 1, wherein the L-shaped slot comprises a circumferentially extending segment, and a dogleg segment extending obliquely therefrom, in the direction of said spring bias.

3. The invention of claim 1, wherein said plunger is solid.

4. The invention of claim 1, wherein said housing has a circumferential mounting flange at its upper end, said flange, having a flat side for providing clearance from a structure on the floor surface.

* * * * *